US005080563A

United States Patent [19]

Tomsett

[11] Patent Number: 5,080,563

[45] Date of Patent: Jan. 14, 1992

[54] FUEL PUMPING APPARATUS

[75] Inventor: Derek W. Tomsett, Gillingham, England

[73] Assignee: Lucas Industries, England

[21] Appl. No.: 481,554

[22] Filed: Feb. 15, 1990

[30] Foreign Application Priority Data

Feb. 17, 1989 [GB] United Kingdom ..... 8903683

[51] Int. Cl.[5] ..... F04B 19/02

[52] U.S. Cl. ..... 417/462; 417/463

[58] Field of Search ..... 417/282, 283, 462, 463, 417/540

[56] References Cited

U.S. PATENT DOCUMENTS

| | | | |
|---|---|---|---|
| 4,173,959 | 11/1979 | Sosnowski et al. | 417/462 |
| 4,299,542 | 11/1981 | Potter et al. | 417/462 |
| 4,310,291 | 1/1982 | Green et al. | 417/462 |
| 4,381,182 | 4/1983 | Broodwith | 417/462 |
| 4,463,727 | 8/1984 | Babitzka et al. . | |
| 4,531,488 | 7/1985 | Kawamura et al. | 417/462 |
| 4,531,491 | 7/1985 | Iiyama et al. | 417/462 |
| 4,759,694 | 7/1988 | Thornthwaite et al. | 417/462 |
| 4,764,092 | 8/1988 | Thornthwaite | 417/462 |
| 4,913,632 | 4/1990 | Thornthwaite | 417/462 |
| 4,920,940 | 5/1990 | Harris et al. | 417/462 |
| 4,936,755 | 6/1990 | Greeves et al. | 417/462 |

FOREIGN PATENT DOCUMENTS

| | | |
|---|---|---|
| 931197 | 7/1963 | United Kingdom . |
| 1122886 | 8/1968 | United Kingdom . |
| 1219631 | 1/1971 | United Kingdom . |
| 2103300A | 2/1983 | United Kingdom . |

*Primary Examiner*—Richard A. Bertsch
*Assistant Examiner*—Alfred Basichas
*Attorney, Agent, or Firm*—Andrus, Sceales, Starke & Sawall

[57] ABSTRACT

A fuel pumping apparatus of the rotary distributor type includes a main pumping plunger and an auxiliary plunger operable at the same time by a cam. During inward movement fuel is displaced by the pumping plunger to an outlet. The auxiliary plunger displaces fuel to a shuttle bore containing a shuttle and during the initial inward movement a first flow path to drain from the bore containing the pumping plunger is open but this is closed upon further movement of the shuttle until a second flow path is opened. The second flow path includes a groove having an inclined edge so that the angular setting of the shuttle determines the amount of fuel supplied through the outlet. A valve is also provided to allow fuel displaced by the auxiliary plunger to flow to a drain.

5 Claims, 1 Drawing Sheet

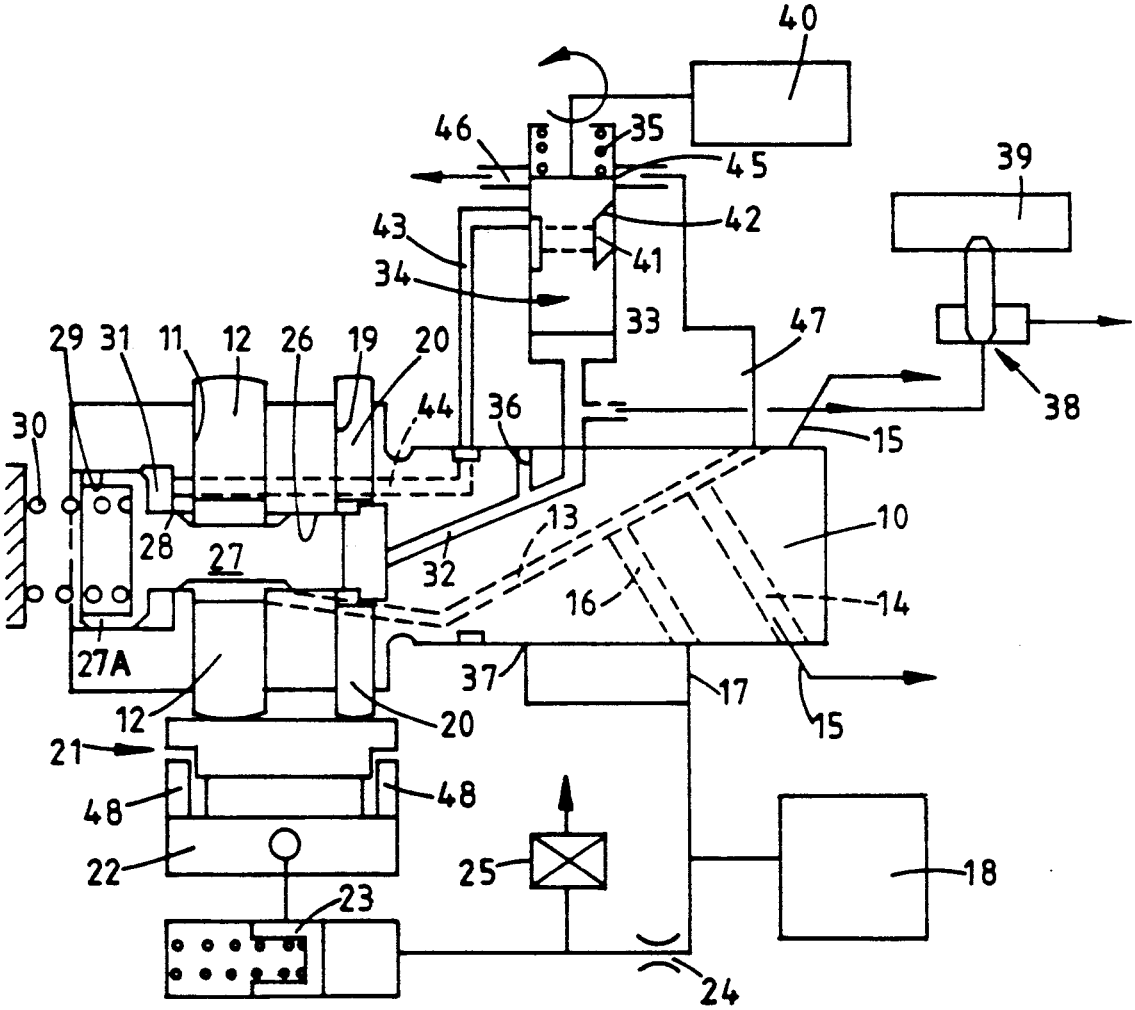
40
46
35
45
39
43
42
41
34
33
47
29
31
11
12
26
19
20
44
36
38
30
15
13
10
28
27
32
16
14
27A
37
17
12
20
15
21
48
48
22
25
18
23
24

FUEL PUMPING APPARATUS

This invention relates to fuel pumping apparatus of the rotary distributor type and comprising a distributor member rotatable in a body in timed relationship with an associated engine, a pumping plunger located in a bore in the distributor member, cam means for imparting inward movement to the plunger as the distributor member rotates, means for feeding fuel from the bore to a plurality of outlet ports in turn during successive inward movements of the plunger, further means for feeding fuel to the bore to achieve outward movement of the plunger during the filling stroke of the apparatus and valve means for controlling the quantity of fuel delivered by the apparatus.

In known forms of apparatus of the kind specified the flow of fuel to the bore is throttled to provide a control of the quantity of fuel delivered by the apparatus. With this form of apparatus the fuel is delivered the whole time the plunger is moved inwardly by cam lobes constituting the cam means. As a result the final rate of fuel delivery and the rate at which the pressure in an outlet falls following delivery, is determined in part by the profiles of the crests of the cam lobes and the size of a roller which forms part of a cam follower located between the cam lobes and the plunger. If the cam profile and/or the roller are modified to increase the final rate of fuel delivery and the rate at which the pressure falls, increased stress occurs in the material forming the roller and the cam lobes.

British Patent specification 990695 shows an apparatus of the aforesaid kind having a pair of plungers and which includes the throttle in the fuel supply to the bore and also has provision for lowering the pressure in the bore before the rollers reach the crest of the cam lobes. The lowering of the pressure which terminates delivery of fuel to the associated engine is achieved by constructing the plungers so that they form a spill path which is opened when during their inward movement, they attain a fixed relative axial position. The construction of the plungers is not without difficulty, moreover, with the aforesaid form of apparatus the timing of the commencement of the fuel delivery depends upon the quantity of fuel supplied to the bore and the timing adjustment besides having to cope with variation of timing as required by changes in engine speed, also has to correct for the variation of timing which occurs as the quantity of fuel supplied by the apparatus is varied.

Another form of apparatus is known from U.S. specification No. 2922370 in which one of the plungers is provided with a helical spill groove which during the inward movement of the plunger, can register with the spill path formed in the bore. Mechanical means is provided to adjust the angular setting of the plunger so that the instant during the inward movement of the plunger at which the spill port is opened, can be adjusted to enable the quantity of fuel delivered by the apparatus to be varied. This form of apparatus provides for a constant start of fuel delivery with a consequent simplification of the timing mechanism. However, since the spill path is defined by one plunger only, variations in the point of spill will occur due to any eccentricity of the cam ring. In addition the provision of mechanical means to effect adjustment of the angular setting of the plunger within its bore is not easy particularly as the plunger is mounted in a rotary part.

In both forms of the pump as described above, the spill path is constituted by the plungers and very careful construction of the plungers is therefore required. Moreover, the area of the spill path may not be sufficient to ensure the required rate of spillage of fuel.

The object of the present invention is to provide an apparatus of the kind specified in a simple and convenient form.

According to the invention in an apparatus of the kind specified said valve means comprises a shuttle slidable in a shuttle bore and biased towards one end thereof, pump means communicating with said one end of the shuttle bore, said pump means being operable in timed relationship with the plunger so that during inward movement of the pumping plunger fluid will be delivered to said one end of the shuttle bore, said shuttle and the shuttle bore defining a first flow path from the bore and which is opened during the initial movement of the pumping plunger by the cam means and a second flow path from the bore which is opened after a predetermined movement of the shuttle following closure of the first flow path and valve means operable to divert fluid fuel from said one end of the shuttle bore until delivery of fuel to the associated engine is required.

An example of a fuel pumping apparatus in accordance with the invention will now be described with reference to the accompanying diagrammatic drawing.

Referring to the drawing the apparatus comprises a rotary cylindrical distributor member 10 which is mounted within a body not shown and is driven in timed relationship with the associated engine. The distributor member is provided with a transverse bore 11 in which is mounted a pair of pumping plungers 12. The pumping chamber defined intermediate the plungers is connected to a passage 13 formed in the distributor member and from which extends a delivery passage 14 positioned to register in turn with a plurality of outlets ports 15 formed in the body and connected in use to the injection nozzles of the associated engine respectively.

Also extending from the passage 13 is an inlet passage 16 which is positioned to register in turn, with a plurality of inlet ports 17 only one of which is shown, formed in the body and connected to the outlet of a low pressure fuel pump 18.

Also formed in the distributor member is a further transverse bore 19 in which is located a pair of plungers 20. The plungers 20 are of smaller diameter than the plungers 12, the two sets of plungers being mounted in side by side relationship. The plungers 12 and 20 are actuated by cam followers 21 only one of which is shown, each cam follower comprising a shoe which is in engagement with the outer ends of the plungers, and a roller which is carried by the shoe and engages with the internal peripheral surface of an annular cam ring part of which is seen at 22. The cam ring in known manner, is provided with pairs of inwardly directed cam lobes and is movable angularly about the axis of rotation of the distributor member by a fluid pressure operable piston 23 which is mounted within a cylinder which is connected by way of a restrictor 24 to the outlet of the pump 18. An electro-magnetic valve 25 is provided whereby the pressure applied to the piston 23 can be controlled.

Traversing the bores 11 and 19 is an axial drilling 26 in which is mounted a valve member 27 shaped to cooperate with a seating edge 28 formed at the junction of the drilling 26 and the wall of a chamber 29. The valve member has a cup-shaped piston member 27A slidable in the chamber 29 and is biased by a spring 30 so that it is urged into engagement with the seating 28. Between the base wall of the chamber 29 and the cup-shaped piston member 27A there is formed a spill chamber 31.

The inner end of the drilling 26 is connected by means of a passage 32 in the distributor member with the inner end of a shuttle chamber 33 which is formed in the body surrounding the distributor member. Slidable in the shuttle chamber is a shuttle 34 which is spring biased towards said one end of the chamber by means of a light spring 35.

The passage 32 is provided with a branch passage 36 which opens onto the periphery of the distributor member and which is positioned to register in turn with a plurality of ports 37 only one of which is shown, which are connected to the outlet of the low pressure pump 18. Furthermore, the aforesaid one end of the shuttle chamber 33 is connected to a control valve 38 which when open diverts fuel from the one end of the shuttle chamber. The valve 38 is controlled by an electro-magnetic actuator 39 and the angular setting of the shuttle 34 is determined by an electro-magnetic actuator 40.

Formed on the periphery of the shuttle is a groove 41 which has an inclined control edge 42. The groove 41 is in constant communication by way of a passage 43, in the body and a cooperating passage 44 in the distributor member with the spill chamber 31. Opening into the shuttle chamber 33 is a control port 45 and extending from the shuttle chamber at a corresponding position, is a drain port 46. The control port 45 in the particular example, is in constant communication by way of a passage 47, with the passage 13 formed in the distributor member although if desired, this communication can be ported.

The operation of the apparatus will now be described ignoring for the moment, the plungers 20 and the shuttle 34. During inward movement of the plungers 12 by the cam lobes, fuel is delivered from the pumping chamber and flows along the passage 13 to the delivery passage 14 which during inward movement of the plungers 12, is in communication with an outlet 15. The communication of the inlet passage 16 with an inlet port 17 is at this time broken and fuel is supplied to the associated engine. As the distributor member continues to rotate the delivery passage 14 moves out of register with an outlet port 15 and the inlet passage 16 moves in to register with an inlet port 17 and fuel is supplied to the pumping chamber to cause outward movement of the plungers 12 by an amount determined by in the particular example, abutment of the shoes of the cam followers with stop rings 48. The cycle is repeated as the distributor member rotates and fuel is supplied to the outlets 15 in turn.

When the plungers 12 move inwardly so also will the plungers 20 and fuel will be displaced along the passage 32 into the one end of the shuttle chamber 33 assuming that the valve 38 is closed. The pressure of fuel required to move the shuttle 34 is less than that required to move the valve member 27 so the latter remains closed. Initially, the control port 45 and the drain port 46 will be open so that fuel displaced from the pumping chamber will flow by way of the control port 45 to a drain by way of the drain port 46. As the plungers move inwardly, however, the shuttle will move against the action of the spring 35 and at some point the control port 45 and the drain port 46 will be closed. Thereafter, fuel will be delivered by the pumping plungers to an outlet 15 and will continue to be delivered until the inclined edge 42 of the groove 41 opens to the control port 45. When this occurs fuel at high pressure flows along the passages 43 and 44 to the spill chamber 31 and the fuel pressure creates a force acting to move the valve member 27 against the action of the spring 30. As soon as the valve member is lifted from the seating 28 the remaining volume of fuel displaced by the pumping plungers 12 flows in to the spill chamber 31 and no more fuel is delivered to the associated engine. When the rollers move over the crests of the cam lobes both sets of plungers can move outwardly and the fuel contained in the spill chamber 31 will be returned to the pumping chamber and the further fuel required to effect outward movement of the pumping plungers will be supplied by way of an inlet port 17 and the inlet passage 16. In addition, the shuttle will be returned by the action of its spring 35 thereby displacing fuel to the bore 19 and any fuel which has been lost, will be made up when the filling port 36 registers with a port 37. Thus at the end of the filling period, all the plungers will have moved outwardly their maximum extent and the shuttle 34 will have assumed its innermost position under the action of the spring 35. The quantity of fuel delivered by the apparatus is determined by the angular setting of the shuttle 34.

As described above the valve 38 was kept in the closed pposition so that as soon as the plungers 20 started their inward movement, movement of the shuttle 34 against the action of the spring 35 took place. However, if the valve 38 is opened such movement of the shuttle will not occur and if the valve remains open for the whole time the plungers are moved inwardly, no fuel will be supplied to the associated engine. If, however, the valve 38 is closed after the inward movement of the plungers has started, delivery of fuel will take place as described and therefore the valve 38 can be used to determine the commencement of fuel delivery to the associated engine. Providing the closure of the valve 38 is not delayed too long after the start of the inward movement of the plungers, the quantity of fuel delivered will be determined as described by the movement of the shuttle. The provision of the valve 38 where the leading flanks of the cam lobes are of a constant rate, enables the valve 38 to be used to determine the timing of commencement of fuel delivery and it may not be necessary to provide the piston 23. If the leading flanks of the cam lobes are of a variable rate the valve 38 can be utilised to control the rate at which fuel is delivered to the associated engine.

It will be understood that two pairs of plungers 12 and two pairs of plungers 20 can be provided if so required.

I claim:

1. A fuel pumping apparatus of the rotary distributor type comprising a rotary distributor member which is rotable in a body in timed relationship with an associated engine, a pumping plunger located in a plunger bore in the distributor member, cam means for imparting inward movement of the pumping plunger as the distributor member rotates, means for feeding fuel from the plunger bore to a plurality of outlet ports in turn during successive inward movements of the pumping plunger, further means for feeding fuel to the plunger bore to achieve outward movement of the pumping plunger during the filing stroke of the apparatus, a shuttle slidable in a shuttle bore, means biasing the shuttle towards one end of the shuttle bore, pump means communicating with said one end of the shuttle bore, the pump means being operable in timed relationship with the pumping plunger so that during inward movement of the pumping plunger fluid will be delivered to said one end of the shuttle bore, first and second fuel flow paths extending from the plunger bore, said flow paths being controlled by the movement of the shuttle in the shuttle bore, said first fuel flow path being open during the initial movement of the pumping plunger by the cam means and closed after a first predetermined movement of the shuttle away from said one end of the shuttle bore, the second flow path being opened after a further predetermined movement of the shuttle following closure of the first fuel flow path and valve means operable to divert fluid from said one end of the shuttle bore until delivery of fuel to the associated engine is required.

2. An apparatus according to claim 1 in which said second flow path communicates with a spill chamber and a slidable member is located in said spill chamber, said piston member being movable by fuel flowing into said spill chamber.

3. An apparatus according to claim 2 including a valve member coupled to said piston member and which is moved to an open position when fuel flows into said spill chamber, said valve member in the open position allowing fuel to flow directly into said spill chamber from said plunger bore.

4. An apparatus according to claim 1 in which said second flow path includes a groove formed on the shuttle, said groove defining an inclined edge and the shuttle being angularly adjustable whereby the extent of said further predetermined movement can be varied.

5. An apparatus according to claim 4 in which said shuttle is movable angularly by an electromagnetic actuator.

* * * * *